United States Patent [19]

Noyce

[11] 4,008,594

[45] Feb. 22, 1977

[54] WIRE COILING MACHINE

[75] Inventor: George Noyce, Cucamonga, Calif.

[73] Assignee: Hartwell Corporation, Placentia, Calif.

[22] Filed: Oct. 2, 1975

[21] Appl. No.: 618,957

[52] U.S. Cl. ..... 72/142; 140/71 R

[51] Int. Cl.[2] ..... B21F 3/04; B21F 35/00

[58] Field of Search ..... 72/133, 135, 142; 140/71 R, 102, 105, 124; 72/131

[56] References Cited

UNITED STATES PATENTS

| | | | |
|---|---|---|---|
| 3,048,199 | 8/1962 | Barnes | 140/71 R |
| 3,227,195 | 1/1966 | Stegmann | 140/71 R |
| 3,677,054 | 7/1972 | Strzepek | 72/142 X |

FOREIGN PATENTS OR APPLICATIONS

| | | | |
|---|---|---|---|
| 887,999 | 12/1971 | Canada | 140/124 |

*Primary Examiner*—C.W. Lanham
*Assistant Examiner*—E. M. Combs
*Attorney, Agent, or Firm*—Lyon & Lyon

[57] ABSTRACT

A wire coiling machine having a pair of spring coiling assemblies which are disposed in coaxial relation and include rotatable heads mounted on coaxial shafts drawn by racks connected to a pair of piston and cylinder units for rotation at different or the same speeds in the same or opposite directions to form a pair of coaxial coils on a single length of wire, the coiling assemblies being axially movable in opposed directions by cam elements and return springs.

11 Claims, 10 Drawing Figures

FIG. 5
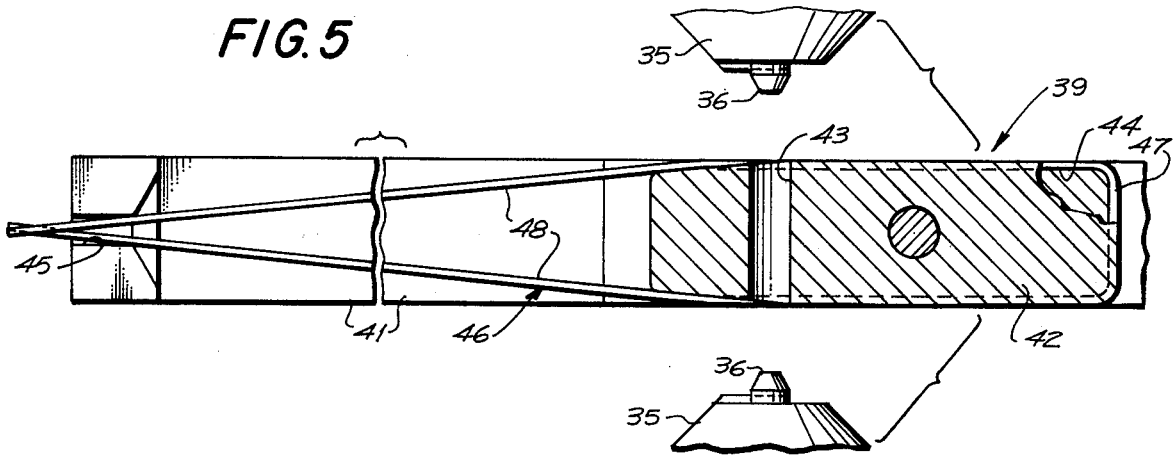
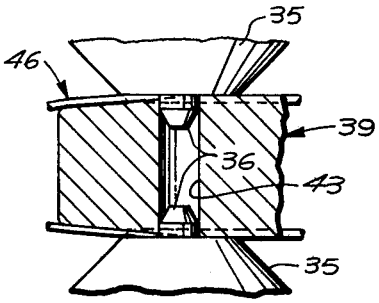
FIG. 6
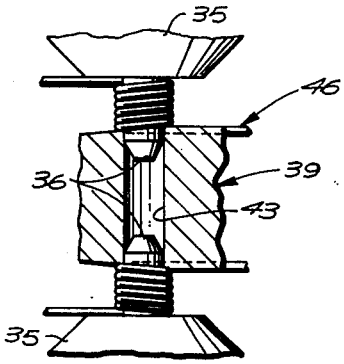
FIG. 7
FIG. 9
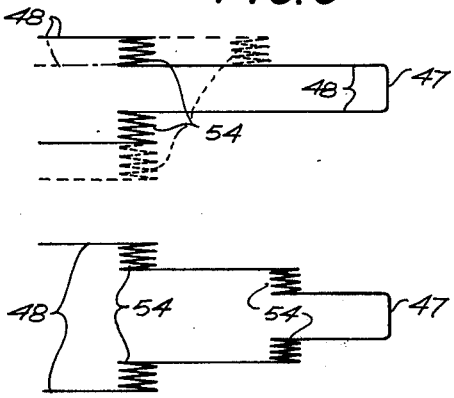
FIG. 10
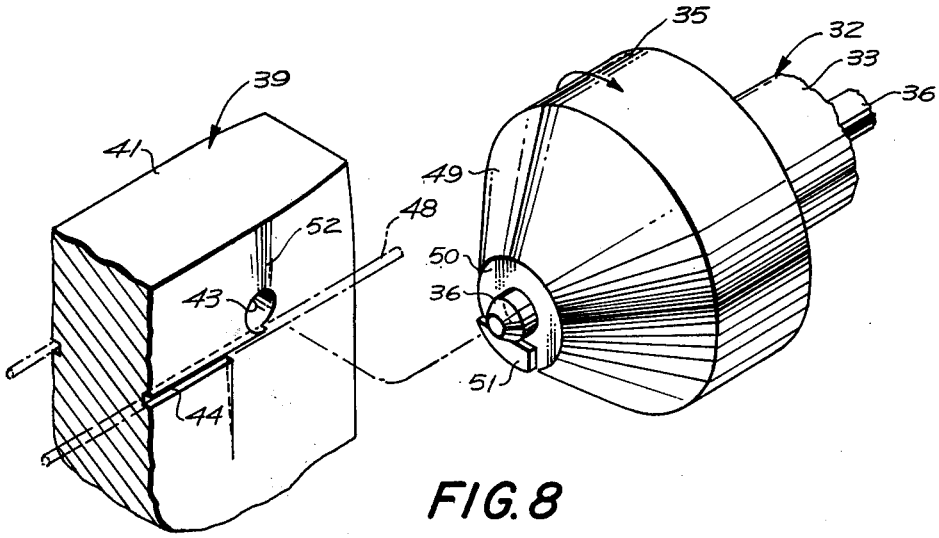
FIG. 8

WIRE COILING MACHINE

BACKGROUND

This application is a further development of a machine for forming or coiling springs, which is disclosed in a copending application Ser. No. 586,210, now U.S. Pat. No. 3,983,732. A feature included in the copending application is an arrangement utilizing a pair of wire coiling assemblies. A modification of these wire coiling assemblies is the subject matter of the present application.

SUMMARY

The present invention is directed to a spring coiling machine and is summarized in the following objects:

First, to provide a wire coiling machine which is particularly adapted to receive a U-shaped wire blank and form simultaneously a pair of coils, and which, by adjustment or by substitution of appropriate forming elements, may be arranged to form pairs of coils of different diameters, or lengths, as well as to form coils of the same or opposite pitch.

Second, to provide a wire coiling machine which utilize a pair of novelly arranged coaxially disposed coiling assemblies, the assemblies being rotatable about a common axis and driven by rack and gear means, which are readily changed as to rate and direction of rotation as well as adjusted as to the number of coils formed.

Third, to provide a wire coiling machine which includes a simple readily changed means for moving the coiling assemblies axially into and out of operating positions.

DESCRIPTION OF THE FIGURES

FIG. 5 is an enlarged fragmentary sectional view taken through 5—5 of FIG. 1, showing the wire coiling blank retainer assembly with the coiling heads in spaced relation thereto.

FIG. 6 is a similar fragmentary sectional view showing the coiling heads in initial engagement with the retainer assembly.

FIG. 7 is a similar view showing the retainer assembly and coiling heads as they appear on completion of the coil winding operation.

FIG. 8 is an enlarged fragmentary perspective view of the wire retainer assembly and a coiling head with the coiling head turned 90 degrees from its normal position for purposes of illustration.

FIGS. 9 and 10 indicate diagrammatically various forms of the product capable of being formed by the wire coiling machine.

DETAILED DESCRIPTION

The wire coiling machine is supported on a mounting plate 1, one end of which is provided with a flat bed 2. Mounted on the bed is a pair of guide or track flanges 3 under which is mounted a pair of base plates 4 for sliding movement to and from each other.

Figure 2:
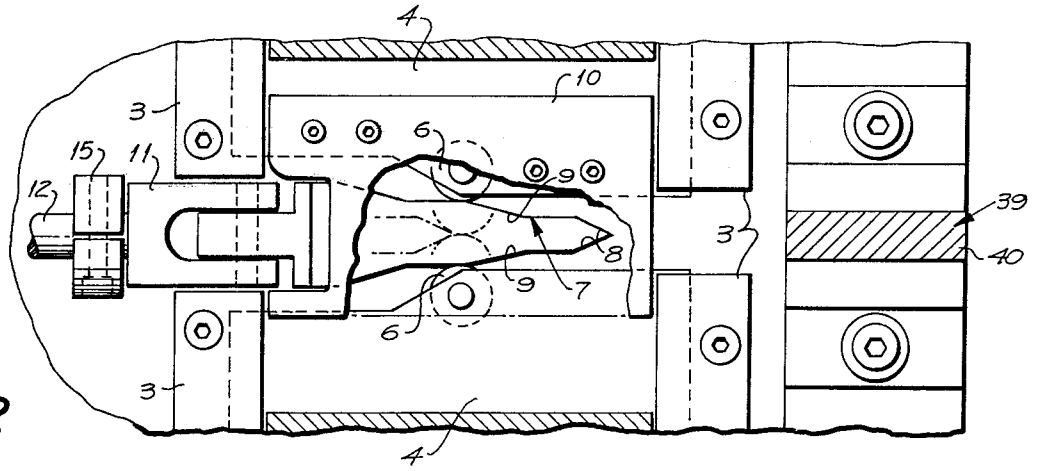
FIG. 2 is an enlarged, fragmentary sectional view taken in the plane at 2—2 of FIG. 1.

The confronting edges 5 of the base plates 4 are provided with a pair of confronting rollers 6, which engage opposite sides of a spreader cam 7, having angular related cam faces 8 and 9 as shown best in FIG. 2. A cover plate 10 is secured to one of the base plates 4 and overlies the other base plate so that the spreader cam 7 is maintained between the rollers 6.

The spreader cam 7 is joined by a coupling 11 to a drive rod or shaft 12 which extends through a cylinder 13. The drive rod is provided with stop clamps 14 and 15 for limiting the degree of travel of the drive rod 12.

Confronting the remote edges of the base plates 4, is a pair of backing plates 16. Springs 17 are positioned between the base plates 4 and the backing plates 16 so as to urge the base plates 4 toward each other and to maintain the rollers 6 in engagement with the spreader cam 7.

Mounted on each base plate 4 is a housing 18 which supports a horizontally extending drive rack 19, one end of which is retained in position by a guide sleeve 20, the other end of which is joined to a coupling 21 attached to a drive rod 22 which extends through a cylinder 23 and is provided with stop clamps 24 and 25 to limit the axial movement of the drive rack 19. The housing 18 supports the cantilever beam 26 from which is suspended the cylinder 23. A bracket 27 extends between the cylinder and the mounting plate 1.

Each housing 18 is provided with a cross-shaft 28 supported by bearings 29. Each cross shaft is provided with a pinion gear 30 which engages the corresponding rack 19. The shaft 29 is also provided with intermediate gear 31.

Each housing slidably and rotatably supports a coiling assembly 32. Each assembly includes a sleeve 33 having an axially elongated integral pinion 34 which engages the intermediate gear 31. One end of the sleeve 33 receives a coiling head 35. Fitted within the sleeve is a mandrel 36, which extends through the coiling head 35. The end of the sleeve 33, remote from the coiling head 35, is received in an end cap 37 and is urged by a spring 38 in a direction of the coiling head 35. The mandrel 36 is adjustably secured in the extremity of the end cap 37.

The two housings 18 are mounted so that the coiling heads 35 and mandrels 36 are in confronting coaxial relation and are moved toward each other by the springs 17 and retracted by the spreader cam 7 through the rollers 6. The housings 18 are located near one end of the mounting plate 1 which constitutes the front end of the machine, thus the cylinders 13 and 23 are disposed at the back portion of the machine.

Mounted between the coiling heads 35 is a wire blank retainer assembly 39 which includes an upright mounting 40 secured to the mounting plate 1, a rearward support 41 secured to the rearward end of the mounting plate 40 and an upper support 42 mounted above the plate 40.

The upper support 42 extends between the coiling heads 35 and mandrels 36 and is provided with a transverse bore 43 in alignment with the mandrels 36 to receive the ends thereof, as shown in FIGS. 5, 6 and 7. The opposite sides and forward end of the support 42 is provided with wire blank retainer channel 44. The upper end of the rearward support 41 is provided with an upwardly exposed notch or groove 45.

The wire coiling machine as illustrated is intended to receive a wire blank 46 which is essentially U-shaped and includes a cross portion 47 and essentially straight arms 48 in which it is intended to form a pair of wire coils. The cross portion 47 and adjacent portions of the arms 48 are received in the channel 44 whereas extremities of the arms 48 extend rearwardly and are received in the notch or grooves 45.

Each coiling head 35 is provided with a tapered end 49 terminating in a surface 50 which is flat except for a boss 51 disposed at one side and forming a shoulder spaced from the mandrel a distance approximating the thickness of the wire 47. Each wire blank retainer channel 44 terminates tangentially to the bore 43, and a cam face portion 52 is provided.

Figure 1:
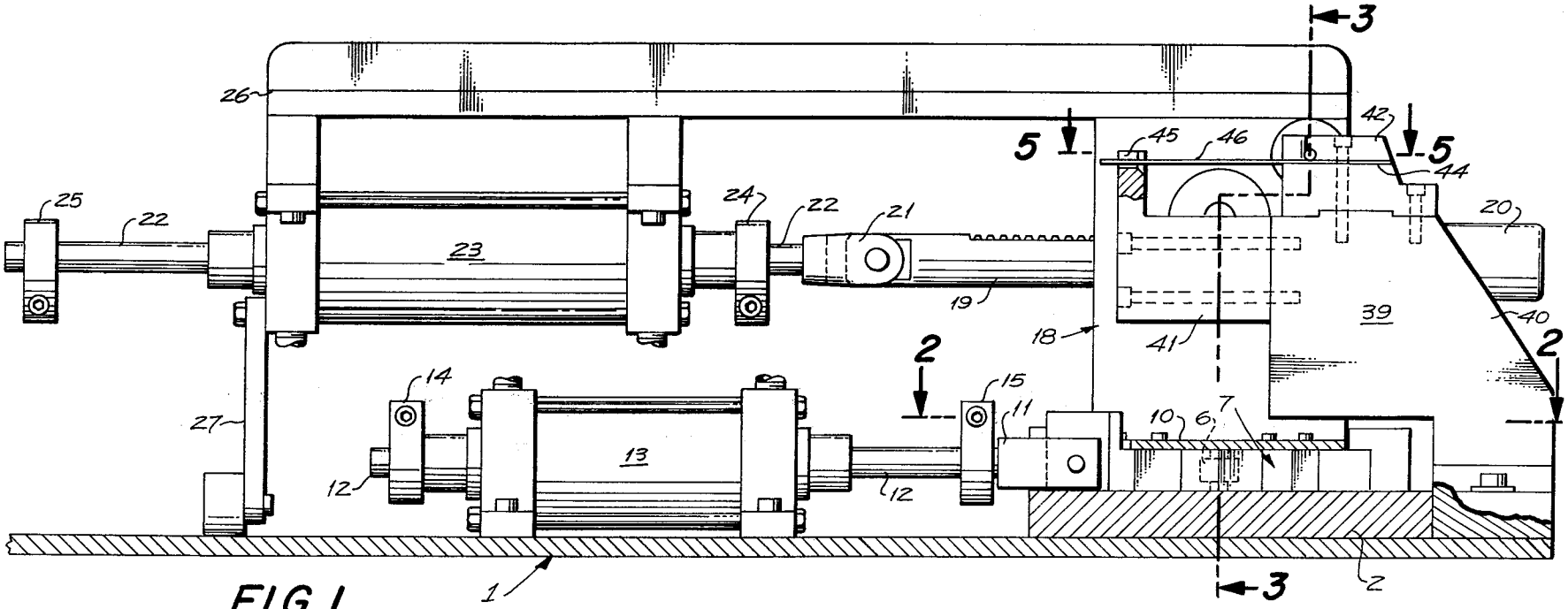
FIG. 1 is a longitudinal sectional view of the wire coiling machine.
Figure 3:
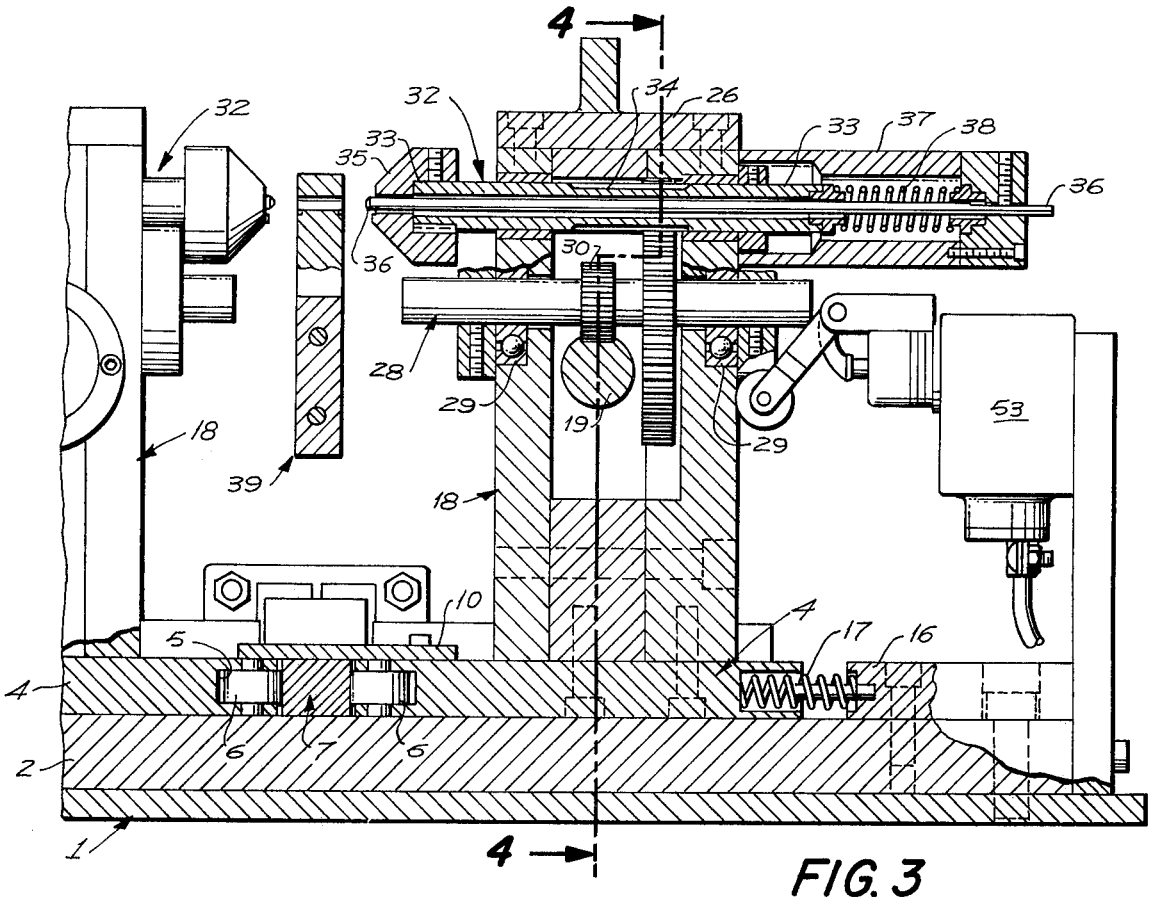
FIG. 3 is an enlarged transfer sectional view taken through 3—3 of FIG. 1.
Figure 4:
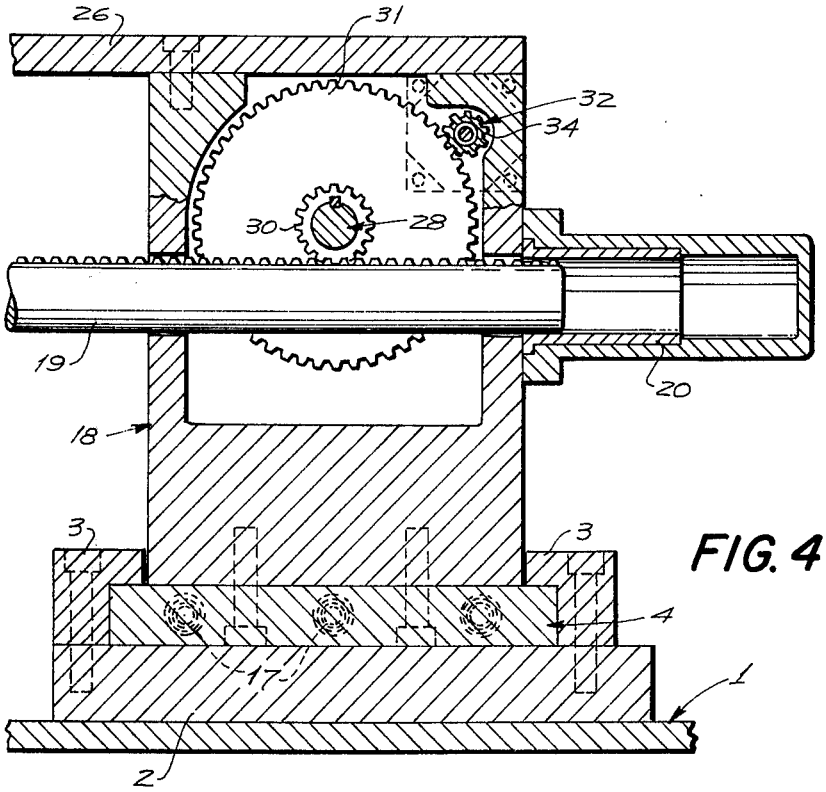
FIG. 4 is an enlarged fragmentary sectional view taken through 4—4 of FIG. 3.

Operation of the wire coiling machine is as follows:

The cam 7 is initially in its forward position shown in FIGS. 1, 2 and 3, placing the coiling heads 35 in spaced relation to the retainer assembly as shown in FIGS. 3 and 5. The wire blank 46 is fitted in the retainer channel 44 with its extremities retained in the notch 45 so that the arms 48 are held yieldably against the opposite sides of the forward support 42. A switch 53 is mounted for engagement by one of the housings 18 to stop the operating cycle for insertion of the wire blank.

After the wire blank 44 is positioned the operator presses the starter button, not shown, to retract the cam 7, causing the coiling heads 35 to engage opposite sides of the forward support 42, and the tips of the mandrels to enter the opposite ends of the bore 43, as shown in FIG. 6.

The two racks 19 are thrust forward causing the coiling assemblies to rotate. As the coiling heads 35 rotate about the cam faces 52, the bosses 51 engage the extended portions of the wire arms 48, withdrawing the extremities of the arms 48 from the notch 45, and coiling the arms 48 about the mandrels 36 to form coiled portions 54.

When the coils 54, reach the desired axial lengths, determined by axial travel of the racks 19, appropriate switches, not shown, may be engaged by one of the stops 24 or 25 to stop further travel of the racks; whereupon, the cam 7 is thrust forward to spread the coiling heads 35 and withdraw the mandrels 36 to permit removal of the coiled wire member.

By substituting different forward supports 41, and coiling heads, wires of different diameter may be coiled; or, by changing the coiling assemblies, coils of different diameter may be formed. Also, either or both coils may be wound in opposite direction, or only one coiling assembly need be operated. Still further, the length of either or both wire coils may be varied by controlling the travel of the racks. Also, two sets of coils may be formed by subsequent operation on one or both arms. By offsetting the axes of the coiling assemblies, the axes of a pair of coils may be offset. these various possibilities are suggested in solid and broken lines in FIGS. 9 and 10.

Having fully described my invention it is to be understood that I am not to be limited to the details herein set forth, but that my invention is of the full scope of the appended claims.

I claim:

1. A wire coiling machine comprising:

a. a supporting means for a wire blank having a cross element and a pair of essentially parallel and coplanar arm elements, the supporting means including an end support for the cross element and opposed side supports for the portions of the arm elements adjacent the cross element, and at least one journal bore tangent to a corresponding arm element intermediate its ends, the portions of the arm elements extending beyond the journal bore being free to coil about the axis of the journal bore;

b. a mandrel axially movable into and out of the journal bore for receiving the extended portion of the arm element as it is coiled;

c. a coiling head rotatable about the mandrel to coil the extended portion of the arm element while the remainder of the wire blank remains fixed on the supporting means.

2. A wire coiling machine as defined in claim 1, wherein:

a. means is provided for moving the mandrel and coiling head clear of the supporting means for placement of a wire blank on the supporting means and removal of a coiled wire therefrom.

3. A wire coiling machine as defined in claim 2, wherein:

a. the coiling head is axially movable along the mandrel as the wire coil is formed to produce coils of various lengths.

4. A wire coiling machine for coiling an essentially U-shaped wire blank including a pair of essentially parallel and coplanar arms, said machine comprising:

a. means having opposing sides for retaining in fixed position the portions of the arms adjacent their U-shaped connection while the extended portions of the arms are free to coil; the retaining means having a bore tangent to the arms at the junctures of their fixed and coilable portions;

b. opposed rotatable coiling heads coaxial with the bore at opposite sides of the retaining means;

c. a mandrel carried by each coiling head and movable into and out of the bore in tangential relation to the corresponding fixed arm carried by the retainer means;

d. cooperative means on the retainer means and coiling heads to cause the coiling heads, upon rotation, to engage and coil the extended portions of the wire blank arms while the remainder of the wire blank remains fixed;

e. and means for rotating the coiling heads to form simultaneously a coil about each mandrel.

5. A wire coiling machine, as defined in claim 4, wherein:

a. means is provided for simultaneously moving the mandrels and coiling heads laterally to and from the retainer means for insertion of a wire blank, and removal of coiled wire.

6. A wire coiling machine as defined in claim 4, wherein:

a. a housing is provided for each mandrel and coiling head in which the mandrel is secured for lateral movement with the housing and yieldable means is provided to permit lateral movement of each coiling head relative to its mandrel and housing for forming coils of various selected length.

7. A wire coiling machine, comprising:

a. a wire blank retaining means arranged to receive an essentially U-shaped wire blank including essentially parallel initial portions and coilable portions initially extending coaxially from the initial arm portions, the retainer means having journal openings tangent to the junctures between the initial and the coilable portions;

b. a mandrel disposed coaxially with a corresponding journal opening for reception thereon;

c. a coiling head surrounding a corresponding mandrel;

d. and drive means for each coiling head, engageable with the corresponding coilable portion including means permitting retraction of the coiling heads from the retaining means as the coil convolutions increase.

8. A wire coiling machine as defined in claim 7, wherein:

a. means is provided to move the coiling heads and mandrels to and from the retaining means for removal of coiled wire and insertion of wire blanks.

9. A wire coiling machine as defined in claim 8, wherein:

a. a housing structure is provided for each coiling head, mandrel and drive means;

b. the housings are yieldably urged toward each other;

c. and wedge means causes separation of the housings.

10. A wire coiling machine, comprising:

a. a base structure having a forward end;

b. a fixed wire retainer means extending upwardly from the base structure and including a channel to receive and retain a portion of a wire blank having an initially coaxial coilable portion extending therefrom, and a mandrel receiving bore tangent to a wire blank placed in the channel at the juncture of the retained and coilable portions of the wire blank;

c. a housing structure mounted on the base structure for movement laterally with respect to the wire retainer means;

d. a coiling assembly carried by the housing structure disposed in axial alignment with the mandrel receiving bore;

e. the coiling assembly including a rotatable sleeve, a mandrel axially slidable in the sleeve having an end for reception in the bore of the wire retaining means, a rotatable coiling head carried by the sleeve and yieldable means urging the coiling head against the wire retainer means, the coiling head including means engageable with the wire blank to coil the coilable portion thereof about the mandrel;

f. means for moving the housing structure laterally to and from the wire retainer means to permit placement of a wire blank in the retainer means channel, and removal of coiled wire from the mandrel;

g. and means for rotating the sleeve and coiling head to effect formation of a wire coil.

11. A wire coiling machine as defined in claim 10, wherein:

a. a pair of housing structures, and coiling assemblies are disposed at opposite sides of the wire retainer means, each side having a wire retainer channel and mandrel receiving bore.

* * * * *